United States Patent [19]

Katayama

[11] Patent Number: 5,061,561

[45] Date of Patent: Oct. 29, 1991

[54] YARN ARTICLE COMPRISING A TETRAFLUOROETHYLENE POLYMER AND A PROCESS FOR PRODUCING THE SAME

[75] Inventor: Shigeki Katayama, Yokohama, Japan

[73] Assignee: Asahi Kasei Kogyo Kabushiki Kaisha, Osaka, Japan

[21] Appl. No.: 382,500

[22] Filed: Jul. 21, 1989

[30] Foreign Application Priority Data

Jul. 25, 1988 [JP] Japan ..... 63-183530

[51] Int. Cl.[5] ..... D02G 3/00

[52] U.S. Cl. ..... 428/364; 57/200; 57/907; 428/398; 428/401; 428/422

[58] Field of Search ..... 428/364, 373, 422, 401, 428/398; 57/907, 200; 264/147

[56] References Cited

U.S. PATENT DOCUMENTS 2,772,444 12/1956 Burrows et al. .
2,776,465 1/1957 Smith .
3,953,566 4/1976 Gore .
3,962,153 6/1976 Gore .
4,025,598 5/1977 Sasshofer et al. ..... 264/140
4,064,214 12/1977 Fitzgerald .
4,168,298 9/1979 Fitzgerald ..... 428/224
4,187,390 2/1980 Gore ..... 428/364

FOREIGN PATENT DOCUMENTS 813331 8/1955 United Kingdom .
1510553 5/1978 United Kingdom .

*Primary Examiner*—Lorraine T. Kendell
*Attorney, Agent, or Firm*—Birch, Stewart, Kolasch & Birch

[57] ABSTRACT

A yarn article comprising a tetrafluoroethylene polymer is disclosed which has a specific bulk density, a specific orientation degree in an axial direction and a specific crystallinity and exhibits specific peaks in the thermogram of differential scanning calorimetry. The yarn article has excellent tensile strength at break and excellent tensile modulus of elasticity as well as inertness to chemicals. Therefore, the yarn article of the present invention can advantageously be used as a material for producing a woven fabric, a knit, a rope and the like, particularly in the field where not only chemical resistance but also high tensile strength and high tensile modulus of elasticity are required.

3 Claims, 3 Drawing Sheets

YARN ARTICLE COMPRISING A TETRAFLUOROETHYLENE POLYMER AND A PROCESS FOR PRODUCING THE SAME

BACKGROUND OF THE INVENTION

1. Field of the Invention

The present invention relates to a yarn article comprising a tetrafluoroethylene polymer and a process for producing the same. More particularly, the present invention is concerned with a yarn article comprising a tetrafluoroethylene polymer, which has a specific bulk density, a specific orientation degree in an axial direction and a specific crystallinity and exhibits two specific peaks in the thermogram of differential scanning calorimetry in the course of temperature elevation. The mechanical strength, e.g., the tensile strength at break, and the tensile modulus of elasticity of the yarn article are extremely high. Therefore, the yarn article of the present invention is advantageously used as a material for producing a woven fabric, a knit, a rope and the like, and the yarn article is useful in fields where the above-mentioned properties are desired.

2. Discussion of Related Art

Polytetrafluoroethylene has excellent chemical inertness, water repellency, electrical insulating properties and the like when compared with a hydrocarbon polymer. Therefore, a yarn article comprising polytetrafluoroethylene has advantageously been used in various fields in place of a yarn article comprising a hydrocarbon polymer. However, polytetrafluoroethylene has a drawback in that because of its poor melt moldability, it was necessary to employ a special process to obtain a yarn article of the polytetrafluoroethylene.

For example, according to U.S. Pat. No. 2,772,444, a dispersion of polytetrafluoroethylene in a viscose is wet spun, and heated at a temperature of from 340° to 400° C. to fuse the polytetrafluoroethylene particles and, at the same time, cause the cellulose to be carbonized, followed by hot drawing, to thereby obtain a yarn article. However, this process is complicated and expensive. Further, the yarn article obtained by this process has unsatisfactory mechanical strength.

British Patent No. 813,331 and U.S. Pat. Nos. 2,776,465 and 4,064,214 disclose various modes of a process which consists in spinning an emulsion of polytetrafluoroethylene or extruding a paste of polytetrafluoroethylene, and sintering the resultant fibrous polytetrafluoroethylene at a temperature not lower than the crystalline melting point of the polytetrafluoroethylene, followed by drawing at a temperature of 340° to 400° C. at a draw ratio of 2 to 30 times, to thereby obtain a yarn article having a high orientation degree. However, the yarn article obtained by the above process has at the most a tensile strength of about 2 g/d and an initial modulus of elasticity of only about 20 to 60 g/d. Therefore, the yarn article obtained by the above process is insufficient in mechanical strength properties for practical application.

In the process of U.S. Pat. Nos. 3,953,566, 3,962,153 and 4,187,390, a paste obtained by mixing a lubricant, such as mineral spirit, with polytetrafluoroethylene is extrusion-molded, the resultant molded product is dried to remove the lubricant, and the dried molded product is drawn at a temperature lower than the crystalline melting point of polytetrafluoroethylene and at a high drawing rate, followed by sintering, at a temperature higher than the crystalline melting point, under a stretched condition to obtain a porous article. The porous article has high mechanical strength, even if the porous article is in the form of a yarn. However, such a porous yarn article has an apparent cross-section area larger than the cross-section area of a non-porous yarn article having the same fineness in terms of denier. With respect to the porous yarn article, the cross-section area, which contains the area of pore portions, is defined as an apparent cross-section area. The mechanical strength of the porous yarn article is not satisfactory in terms of the mechanical strength per unit apparent cross-section area because of its porous structure, as compared to the mechanical strength per unit cross-section area of a non-porous yarn article. Accordingly, the porous yarn article is not satisfactory in applications in which the use of a very fine yarn article having high mechanical strength is required. When a woven fabric is produced using the porous yarn article, since the maximum thread count per unit length or width of the woven fabric depends upon the thickness of the yarn article, the maximum thread count of the fabric made of the porous yarn article is small as compared with that of a fabric made of the non-porous yarn article having the same fineness as the porous yarn article. Accordingly, the tensile strength per unit width of the woven fabric made of the porous yarn article is lower than that of the woven fabric made of the non-porous yarn article. Therefore, when it is intended to produce a woven fabric having a high mechanical strength, it is disadvantageous to use such a porous yarn article. Moreover, the porous yarn article is generally poor in resistance to a force applied in the radial (or thickness-wise) direction, so that the porous yarn article has poor compressive resistance. For example, when a high density woven fabric made of a porous yarn article is used as a filter fabric for a prolonged period of time, the weave pattern is disarranged, due to the creep of the porous yarn article, so that the woven fabric can no longer serve as a filter fabric.

U.S. Pat. Nos. 3,953,566 and 3,962,153 also disclose a process for producing a film of polytetrafluoroethylene having a low porosity by pressing a film of polytetrafluoroethylene having a high porosity. Although the porosity of the film obtained by this process is reduced by the pressing, the film still has a porosity of about 3%, and has a structure comprised of nodes interconnected by fibrils. Further, the mechanical strength of the obtained film is not increased or rather is lowered by the pressing as compared to that of the starting film which has not yet been subjected to being pressed.

In these situations, a polytetrafluoroethylene yarn article having a very high mechanical strength and modulus of elasticity has been desired commercially.

SUMMARY OF THE INVENTION

The present inventors have conducted extensive and intensive studies with a view toward developing a yarn article comprising a tetrafluoroethylene polymer which has a tensile strength and tensile modulus of elasticity properties which are much higher than those of conventional yarn articles comprising a tetrafluoroethylene polymer. As a result, it has unexpectedly been found that a non-porous yarn article comprising a tetrafluoroethylene polymer which has excellent tensile strength and tensile modulus of elasticity can be produced by drawing a tetrafluoroethylene polymer filament having a specific microporous structure provided by a specific manufacturing process at a temperature of not lower than the melting point of the tetrafluoroethylene polymer filament. The present invention has been completed, based on this novel finding.

It is, therefore, an object of the present invention to provide a yarn article comprising a tetrafluoroethylene polymer which has excellent tensile strength and tensile modulus of elasticity.

The foregoing and other objects, features and advantages of the present invention will be apparent to those skilled in the art from the following detailed description and appended claims taken in connection with the accompanying drawings.

DETAILED DESCRIPTION OF THE INVENTION

In one aspect of the present invention, there is provided a yarn article comprising a tetrafluoroethylene polymer, which has an bulk density of 2.15 to 2.30, an orientation degree in an axial direction of 0.9 or more and a crystallinity of 85% or more and exhibits peaks at 345°±5° C. and 380°±5° C. in the thermogram of differential scanning calorimetry in the course of temperature elevation at a rate of 10° C./min.

The terminology "yarn article" used herein means a staple fiber, a filament, a fine tape and the like. There is no particular restriction with respect to the shape and area of the cross-section of the yarn article of the present invention. However, the yarn article is preferably a monofilament having a fineness of 100 denier or less, more preferably a monofilament having a fineness of several to 50 denier.

There is no particular restriction with respect to the polymerization degree of the tetrafluoroethylene polymer for use in the preparation of the yarn article of the present invention. A tetrafluoroethylene polymer having a polymerization degree which the conventional tetrafluoroethylene polymer generally possesses may be employed. The tetrafluoroethylene polymer may be a homopolymer or a copolymer. In the present invention, a tetrafluoroethylene homopolymer is preferred. The tetrafluoroethylene copolymer may comprise tetrafluoroethylene units and a small amount, for example, 1% or less by mole of other recurring units based on the total mole of all of the units of the copolymer, as long as the effect of the copolymer of the present invention is not impaired by the other recurring units. Representative examples of other recurring units include ethylene units; halogen-substituted ethylene units, such as chlorotrifluoroethylene units; fluorine-substituted propylene units, such as hexafluopropyrene units; and fluorine-substituted alkyl vinyl ether, such as perfluoropropyl vinyl ether.

The terminology "non-porous yarn article" used herein means that the yarn article has permeabilities for gases or liquids which are substantially equal to those of the conventional polytetrafluoroethylene film and has an bulk density of 2.15 to 2.30, preferably 2.20 to 2.25, and that no microporous structure comprised of nodes interconnected by fibrils is observed by electron microscopy. On the other hand, the terminology "microporous yarn article" used herein means that the yarn article has a permeability for nitrogen gas of about $1\times10^{-8}$ to about $1\times10^{-1}$ [$cm^3$(STP)·cm/$cm^2$S(cmHg)], and, a porosity of 40 to 97%, i.e., an bulk density of 0.07 to 1.33, and that a microporous structure comprised of nodes interconnected by fibrils is observed by electron microscopy. The features of the microporous yarn article as a starting material are substantially the same as those of the porous material disclosed in U.S. Pat. No. 4,187,390 mentioned above.

Figure 1:
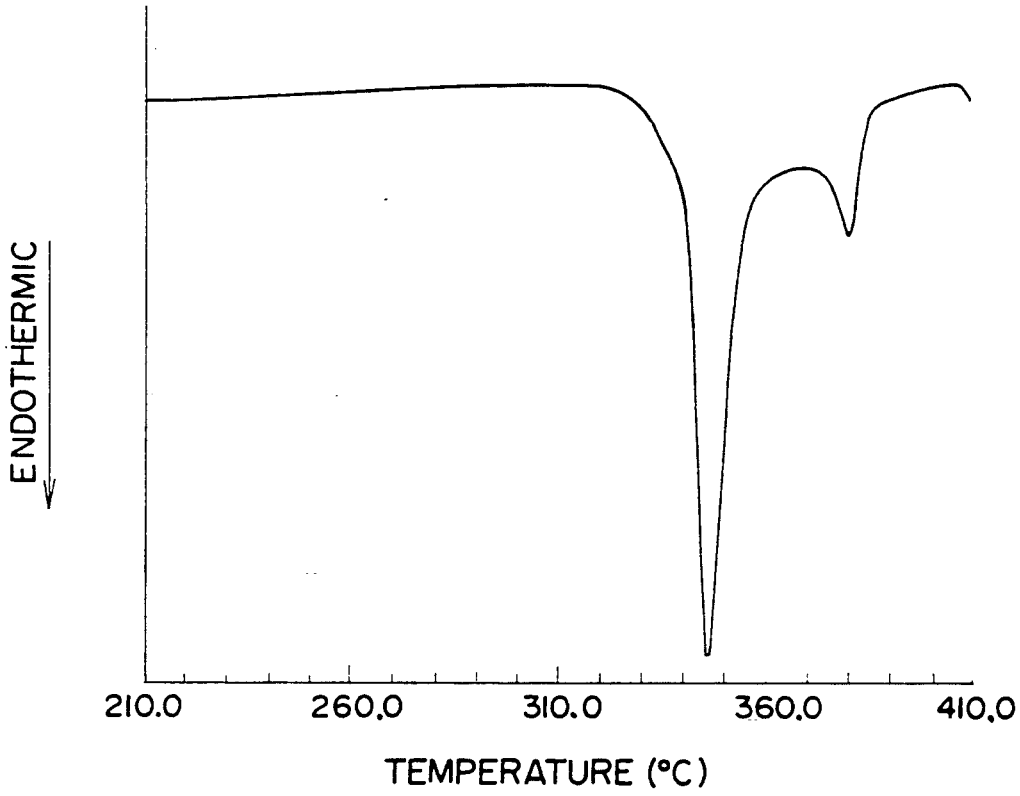
FIG. 1 is a thermogram of differential scanning calorimetry with respect to a yarn article of the present invention obtained in Example 1, showing the course of temperature elevation at a rate of 10° C./min.

The yarn article of the present invention exhibits a first endothermic peak at about 345°±5° C. and a second endothermic peak at 380°±5° C. in the course of temperature elevation from room temperature at a rate of 10° C./min in the thermal analysis by differential scanning calorimetry (DSC) (see FIG. 1). When the yarn article is maintained at 420° C. for 30 minutes and subsequently cooled to room temperature at a rate of 10° C./min for crystallization, these peaks disappear and, instead, a different endothermic peak appears at about 330° C. in the DSC thermogram. This different peak shows that the crystalline system of the yarn article of the present invention changes by the heat treatment, and the crystalline system of the heat-treated yarn article becomes the same as that of the conventional polytetrafluoroethylene.

Conventional tetrafluoroethylene polymer yarn articles generally exhibit only one peak at a temperature of about 330° C. (see FIG. 3) in the DSC thermogram.

Figure 2:
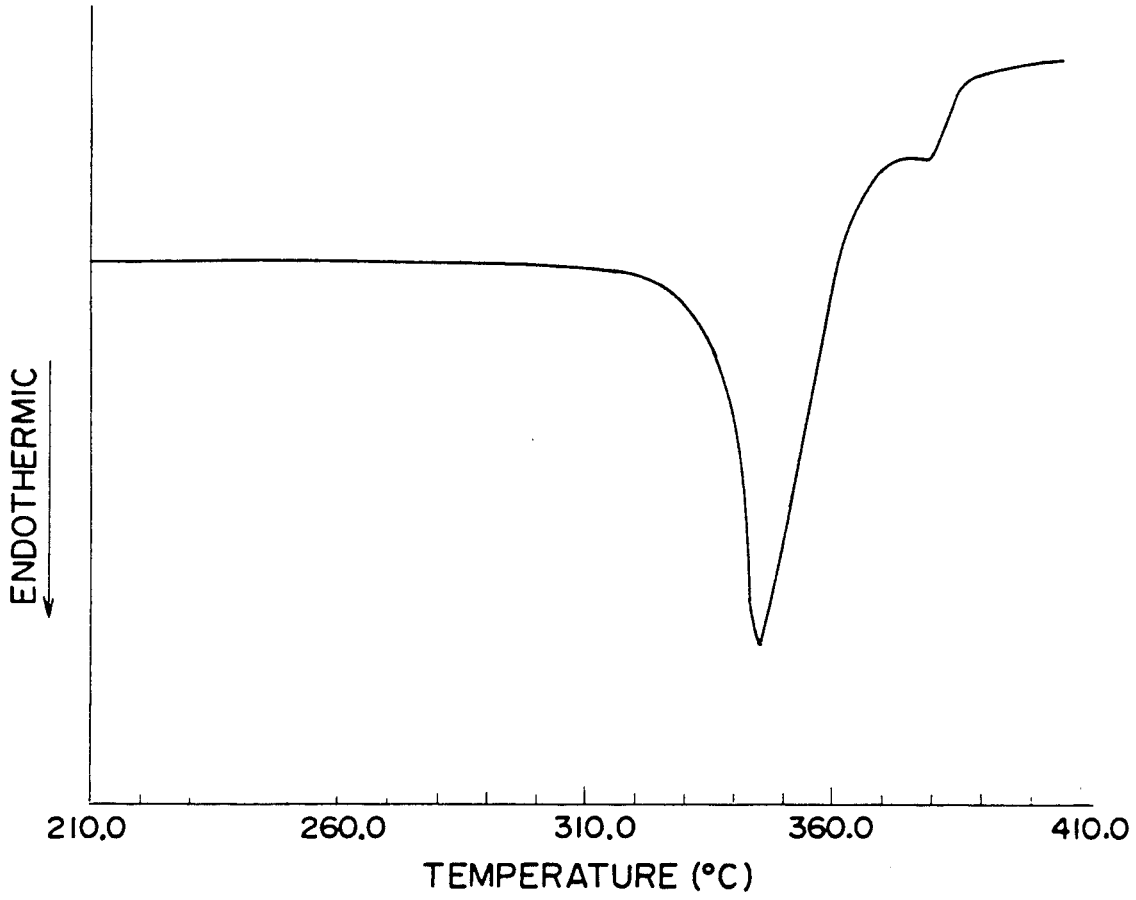
FIG. 2 is a thermogram of differential scanning calorimetry with respect to a microporous sheet used as a starting material in Example 1, showing the course of temperature elevation at a rate of 10° C./min.

Further, it is noted that a tetrafluoroethylene polymer yarn article which exhibits two peaks at 340°±5° C. and 380°±5° C., respectively (see FIG. 2) is also known in the art. The first of the two peaks has a high intensity but the second of the peaks has an extremely low intensity. This conventional tetrafluoroethylene polymer yarn article exhibiting two particular peaks can be produced by conventional processes, e.g., by the processes disclosed in U.S. Pat. Nos. 3,953,566, 3,962,153 and 4,187,390. This type of tetrafluoroethylene polymer yarn article can advantageously be used for preparing the yarn article of the present invention.

The yarn article of the present invention is preferably produced from such a conventional tetrafluoroethylene polymer yarn article exhibiting two particular peaks in the DSC thermogram, and as mentioned above, exhibits clearly observable peaks at 345°±5° C. and 380°±5° C. in the DSC thermogram. This means that the conversion from this conventional yarn article to the yarn article of the present invention is unexpectedly accompanied by a temperature shift with respect to the first peak and an intensity increase with respect to the second peak. From the above, it is apparent that the yarn article of the present invention has a novel structure which is different from the crystalline system of the conventional polytetrafluoroethylene. The two peaks at 345°±5° C. and at 380°±5° C. in the thermogram of DSC analysis of the yarn article of the present invention are caused to appear due to the drawing of the above-mentioned conventional yarn article having two particular peaks, which is not non-porous but microporous, at a temperature not lower than the crystalline melting point of this microporous yarn. The structure of the yarn article of the present invention which exhibits the abovementioned two peaks in the thermogram of DSC analysis of the yarn article, contributes to high tensile strength and high tensile modulus of elasticity without sacrificing other desired properties inherent in the tetrafluoroethylene polymer.

The yarn article of the present invention is prepared by drawing in an axial direction, and has an extremely high orientation degree and crystallinity. That is, according to the measurement by X-ray diffractometry, the orientation degree of the yarn article of the present invention is 0.9 or more, preferably 0.95 or more, and its crystallinity is 85% or more, preferably 95% or more. There is no particular restriction with respect to the upper limits of the orientation degree and the crystallinity of the yarn article of the present invention. According to the process for producing the yarn article of the present invention as described hereinbelow, it is possible to obtain a yarn article having an orientation degree of 0.99 and a crystallinity of 99% by conducting the drawing at a high drawing temperature and at a high draw ratio.

The yarn article according to the present invention has a tensile strength of 4 g/d to 8 g/d, preferably not smaller than 5 g/d in the direction of drawing and a tensile modulus of elasticity of 200 g/d to 500 g/d (as initial tensile modulus of elasticity), preferably not smaller than 250 g/d.

The yarn article of the present invention can readily be produced by the following process.

Therefore, in another aspect of the present invention, there is provided a process for producing a yarn article comprising a tetrafluoroethylene polymer, which comprises drawing a tetrafluoroethylene polymer filament at a temperature not lower than the melting point of the tetrafluoroethylene polymer filament, the tetrafluoroethylene polymer filament having an orientation degree of 0.7 or more and having a microporous structure comprised of nodes interconnected by fibrils, to thereby obtain a yarn article of a tetrafluoroethylene polymer having an bulk density of 2.15 to 2.30, an orientation degree in an axial direction of 0.9 or more and a crystallinity of 85% or more and exhibits peaks at 345°±5° C. and 380°±5° C. in the thermogram of differential scanning calorimetry in the course of temperature elevation at a rate of 10° C./min.

The microporous tetrafluoroethylene polymer filament used as a starting material is monoaxially orientated and generally has an orientation degree of 0.7 to 0.9. The starting tetrafluoroethylene polymer filament preferably exhibits one peak with a high intensity at 340°±5° C. and another peak with an extremely low intensity at 380°±5° C. in the DSC thermogram. Further, the starting tetrafluoroethylene polymer filament preferably has a porosity of 40 to 70% (corresponding to an bulk density of from 1.21 to 0.69), a crystallinity of 70 to 90%, a tensile modulus of elasticity of 60 to 180 g/d and a tensile strength of 2.8 g/d to 4.0 g/d. The starting filament can be obtained in accordance with the conventional processes. For example, as disclosed in U.S. Pat. Nos. 3,953,566, 3,962,153 and 4,187,390, the starting filament can be obtained by extrusion-molding a paste comprising a tetrafluoroethylene polymer and mineral spirit as an extrusion auxiliary, drying the resultant extrudate to remove the mineral spirit, and drawing the dried product at a temperature lower than the crystalline melting point of the tetrafluoroethylene polymer at a draw ratio larger than 10%/sec., if desired, followed by heat treatment (i.e., sintering) of the drawn product at a temperature higher than the melting point of the tetrafluoroethylene polymer.

It is preferred to use a starting tetrafluoroethylene polymer filament which has been subjected to the above-mentioned heat treatment at a temperature higher than the melting point of the tetrafluoroethylene polymer (usually at a temperature of from about 360° to about 420° C.) because the effect of the drawing is promoted.

In the present invention, it is requisite to draw the starting microporous filament of a tetrafluoroethylene polymer at a temperature not lower than the melting point of the tetrafluoroethylene polymer. By this drawing, the microporous tetrafluoroethylene polymer is rendered non-porous, so that unexpected high tensile strength and high tensile modulus of elasticity can be achieved.

In the present invention, the drawing temperature is important. The drawing temperature is selected from the temperatures of not lower than the melting point of a tetrafluoroethylene polymer which is generally in the range of about 327° to about 340° C. melting point. The drawing temperature is preferably 350° C. or more. On the other hand, when the drawing temperature is too high, thermal decomposition of the tetrafluoroethylene polymer occurs, so that the tensile strength and tensile modulus of elasticity of the resultant yarn article are likely to be inferior. The drawing temperature is preferably in the range of 350° to 420° C.

The draw ratio is generally in the range of 1.5 to 10, preferably in the range of 2 to 6.5. When the draw ratio is too high, it is difficult to smoothly perform stable drawing.

The drawing may be carried out in one stage or in multi-stage.

When the microporous tetrafluoroethylene polymer filament as a starting material is twisted prior to the drawing, the stability of drawing operation is improved, so that it is possible to carry out the drawing at a high draw ratio, thereby enabling an extremely fine yarn article to be produced. Moreover, the twisting is effective for to obtaining monofilaments having a highly circular cross-section.

The twisting is conducted at a twist ratio of generally from 400 to 5000 times per meter, preferably from 700 to 3000 times per meter.

For carrying out the twisting, any conventional twisters, for example, the well-known Italy model twister and ring type twister, are used.

Figure 4:
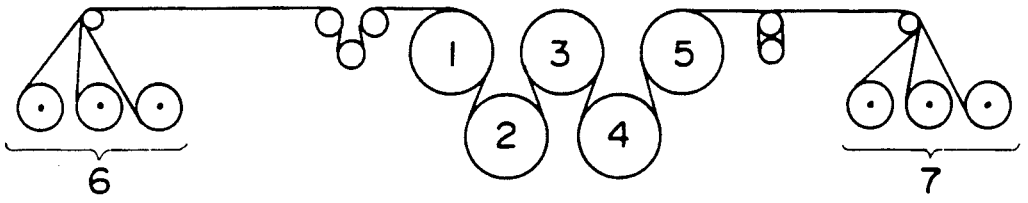
FIG. 4 shows a diagrammatic view illustrating a roll type drawing machine used in Example 3.

Means and apparatus for the drawing are not particularly limited. An apparatus as used in the drawing of conventional yarn articles can be used, which is provided with heated or not-heated feed rolls and wind-up rolls. When not-heated feed rolls are used, an appropriate heating device, for example, a hot plate or an inorganic salt bath comprising potassium nitrate, sodium nitrate or sodium nitrite is used for heating the starting tetrafluoroethylene filament. Alternatively, the heating of the filament may be conducted with hot air in an electric furnace. A preferred example of apparatus for attaining the drawing is a roll-drawing machine provided with at least one pair of heated rolls. A preferred form of the apparatus is shown in FIG. 4. In FIG. 4, numerals 1 to 3 represent heated feed rolls, numerals 4 and 5 represent wind-up rolls which may optionally be cooled, numeral 6 represents an unwinder and numeral 7 represents a winder. The drawing is effected between roll 3 and roll 4. Therefore, rolls 4 and 5 are rotated at a higher revolution speed than these of rolls 1 to 3, which speed depends on the draw ratio.

Although the drawing speed is not particularly limited, the drawing speed is preferably about 1000%/min.

The yarn article of the present invention has high tensile strength and high tensile modulus of elasticity as well as inertness to chemicals and, therefore, it is useful as ropes, woven fabrics, knitted products and the like, particularly in the field where not only chemical resistance but also high tensile strength and high tensile modulus of elasticity are required.

In the present invention, the orientation degree, tensile strength at break, tensile modulus of elasticity, bulk density and DSC characteristics are measured as follows:

1) Orientation Degree

The orientation degree is measured, in accordance with the method described in "Seni Binran (Textile Handbook)" edited by Seni Gakkai (Society of Textile), published by Maruzen Co., (Third printing, 1974), Part I of Fundamentals, chapter 1.5. 8c (page 84).

The orientation in plane (100) of polytetrafluoroethylene is examined by means of X-ray diffraction. The orientation degree (f) can be obtained by the formula:

$$f = \frac{3<\cos^2\phi> - 1}{2}$$

wherein an angle $\phi$ represents the slant of a crystal face relative to the fiber axis, and $<\cos^2\phi>$ is the average of values of $\cos^2\phi$ obtained by the following formula:

$$<\cos^2\phi> = \frac{\int_0^{\pi/2} I(\Omega)\cdot\sin^2\Omega\cdot\cos\Omega\cdot d\Omega}{\int_0^{\pi/2} I(\Omega)\cdot\cos\Omega\cdot d\Omega}$$

wherein, $\Omega$ represents the angle of rotation (azimuth angle) relataive to the fiber axis and $I(\Omega)$ represents the scattering intensity of X-ray at the azimuth angle ($\Omega$).

2) Crystallinity

Using the X-ray diffraction pattern of a yarn article, the crystallinity is calculated from the ratio of the area in the range of 15° to 25° ($2\theta$) of a peak ascribed to the crystalline phase of the yarn article to the area of the background, assuming that the background is ascribed to the amorphous phase of the yarn article.

3) Tensile Strength at Break and Initial Tensile Modulus of Elasticity

The tensile strength at break and initial tensile modulus of elasticity are measured using an Instron type tensile tester under the following conditions:

temperature: 25° C.
relative humidity (RH): 50%
distance between the grips: 50 mm
stress rate: 200 mm/min.

4) Bulk Density

The bulk density is measured by means of a specific gravity bottle using water of 25° C. as a medium.

5) DSC Characteristics

Differential scanning calorimetry (DSC) analysis is conducted at a temperature elevation rate of 10° /min starting from 30° C. by means of DSC-100 (manufactured and sold by Seiko Denshi Co., Japan).

DETAILED DESCRIPTION OF PREFERRED EMBODIMENTS

The present invention will now be described in detail with reference to the following Reference Examples, Examples and Comparative Examples which should not be construed as limiting the scope of the present invention.

EXAMPLE 1

A porous polytetrafluoroethylene sheet of 25 μm in thickness produced in accordance with the process disclosed in U.S. Pat. No. 3,962,153.

This porous sheet has a porosity of 48%, an bulk density of 1.15, a crystallinity of 81% and an orientation degree of 0.86 (orientation angle of 18° ). In the DSC analysis of the porous sheet, a main endothermic peak appears at 341° C. and its endothermic energy (ΔH) is 35.7 millijoules/mg. Further, a second peak appears at 380° C. and its endothermic energy (ΔH) is as small as 1 mj/mg (see FIG. 2). The initial tensile modulus of elasticity, tensile strength at break and heat shrinkage at 250° C. of this sheet are 100 g/d (10 GPa), 2.1 g/d (0.21 GPa) and 3.5%, respectively.

This sheet is slitted to obtain a filament of 200 denier. The filament is then twisted at a twist ratio of 750 times per meter. Then, the twisted filament is continuously drawn in a 1 m-length oven at 440° C. at a drawing rate of 1,000%/min, so that the resultant filament (one form of a yarn article of the present invention) has a length 4 times that of the original filament. The temperature of the resultant filament is 400° C. The thus obtained filament has a fineness of 50 denier, an bulk density of 2.20, a porosity of 1%, a crystallinity of 96% and an orientation degree of 0.99 (orientation angle of 4.7° ), and exhibits, in the thermogram of DSC, two endothermic peaks at 342° C. and 381° C. with endothermic energies (ΔH) of 38.0 millijoules/mg and 5.7 millijoules/mg, respectively. The filament also has an initial tensile modulus of elasticity 330 g/d (64 GPa), a tensile strength at break of 6.5 g/d (1.26 GPa) and a heat shrinkage at 250° C. of 0.5%.

EXAMPLE 2

Microporous filaments obtained from the starting polytetrafluoroethylene sheet as used in Example 1 individually are drawn in substantially the same manner as in Example 1, except that the filament is drawn so that the resultant filament has a length 2 times that of the original filament and except that various drawing temperatures are employed as shown in Table 1 to obtain filaments 2-1 to 2-4. The filaments 2-1 to 2-4 exhibit two endothermic peaks at 345° C. with an endothermic energy (ΔH) of 38.3 millijoules/mg and at 379° C. with an endothermic energy (ΔH) of 4.8 millijoules/mg; two peaks at 346° C. with an endothermic energy (ΔH) of 37.8 millijoules/mg and at 379° C. with an endothermic energy (ΔH) of 5.2 millijoules/mg; two peaks at 345° C.

with an endothermic energy (ΔH) of 33.6 millijoules/mg and at 378° C. with an endothermic energy (ΔH) of 5.1 millijoules/mg; and two peaks at 346° C. with an endothermic energy (ΔH) of 34.0 millijoules/mg and at 380° C. with an endothermic energy (ΔH) of 5.7 millijoules/mg, respectively. The properties of filaments 2-1 to 2-4 are also shown in Table 1.

TABLE 1

| | 2-1 | 2-2 | 2-3 | 2-4 |
|---|---|---|---|---|
| oven temperature (°C.) | 360 | 400 | 440 | 480 |
| thread temperature at outlet (°C.) | 350 | 370 | 390 | 410 |
| bulk density | 2.20 | 2.22 | 2.22 | 2.23 |
| orientation degree | 0.96 | 0.98 | 0.98 | 0.99 |
| orientation angle (°) | 9.5 | 7.0 | 7.0 | 4.7 |
| crystallinity (%) | 91.2 | 95.5 | 95.8 | 96.1 |
| fineness (denier) | 102 | 98 | 97 | 97 |
| initial tensile modulus of elasticity (g/d) | 286 | 325 | 293 | 315 |
| tensile strength at break (g/d) | 5.4 | 5.7 | 5.8 | 5.7 |

COMPARATIVE EXAMPLE 1

A non-sintered sealing tape of 15 mm in width is prepared by extrusion of a polytetrafluoroethylene paste. This tape is sintered at 400° C. for 10 minutes in accordance with Example 6 of U.S. Pat. No. 2,776,465 to obtain a transparent tape. This tape is drawn in an oven at a temperature of 400° C. by means of the same drawing machine used in Example 1, so that the resultant drawn tape has a length 4 times the length of the original transparent tape.

Figure 3:
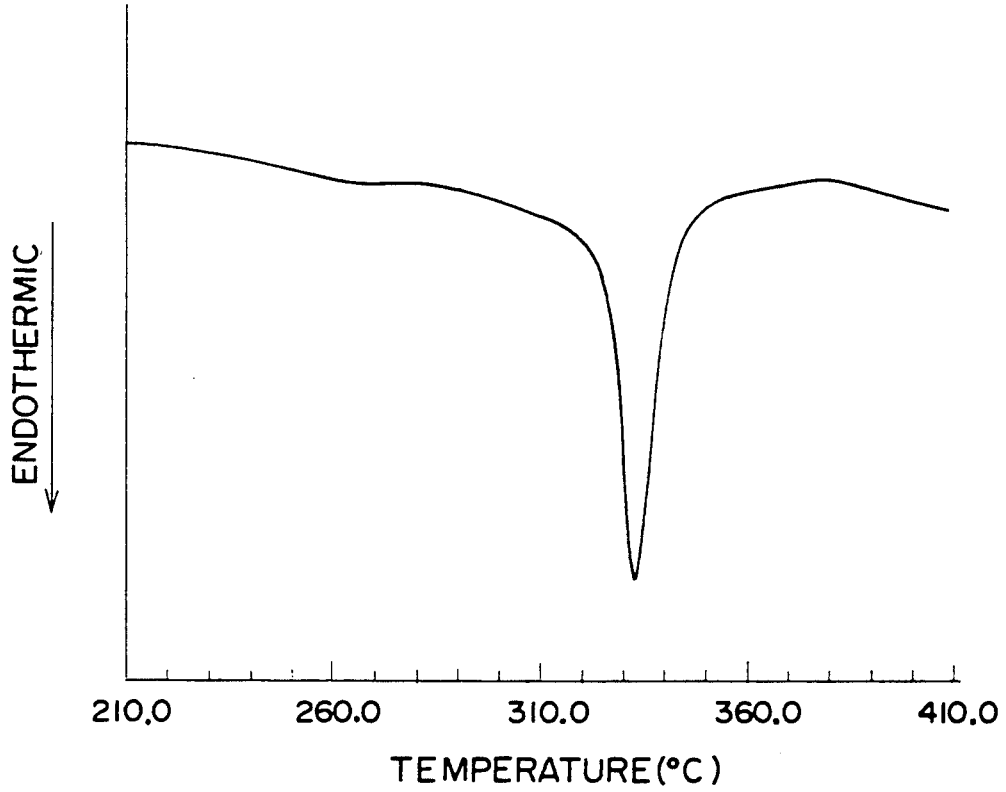
FIG. 3 is a thermogram of differential scanning calorimetry with respect to a tape finally obtained in Comparative Example 1, showing the course of temperature elevation at a rate of 10° C./min.

The drawn tape thus obtained has a crystallinity of 90%, an orientation degree of 0.92 (orientation angle of 13°), an initial tensile modulus of elasticity of 12 g/d, a tensile strength at break of 1.5 g/d and a tensile elongation at break of 12.5%, and only one endothermic peak is observed in the thermogram of DSC (see FIG. 3).

EXAMPLE 3

The same microporous filament as used in Example 1 is twisted at a twist ratio of 1000 times per meter, and the twisted filament is continuously drawn for 8 hours at a feed rate of 10 m/min and a take-off speed of 30 m/min by the use of a roll drawing machine with rolls heated at 400° C., as shown in FIG. 4, thereby obtaining a yarn article.

The thus obtained yarn article is transparent, and has a circular cross-section, an bulk density of 2.21 and a fineness of 69 denier. The yarn article also has an orientation degree, as measured by X-ray diffractiometry, of 0.98, a crystallinity of 95%, an initial tensile modulus of elasticity of 290 g/d (56 GPa), a tensile strength at break of 6.2 g/d (1.2 GPa) and a tensile elongation at break of 5.6%. The yarn article exhibits a first peak at 345° C. with an endothermic energy (ΔH) of 38 millijoules/mg and a second peak at 382° C. with an endothermic energy (ΔH) of 11 millijoules/mg.

EXAMPLE 4

Effect of the Number of Twists

The same microporous filaments as used in Example 1 individually are subjected to drawing in substantially the same manner as in Example 1, except that the number of twists is varied as shown in Table 2 to obtain yarn articles 3-1 to 3-5. In drawing each twisted microporous filament, the draw ratio is changed stepwise at intervals of 30 minutes to determine the maximum draw ratio of yarn article. The maximum draw ratio means a draw ratio at which continuous drawing can be stably conducted for at least 30 minutes. The maximum draw ratios of yarn articles 3-1 to 3-5 are also shown in Table 2.

TABLE 2

| | 3-1 | 3-2 | 3-3 | 3-4 | 3-5 |
|---|---|---|---|---|---|
| number of twists (times/m) | 0 | 500 | 1000 | 2000 | 3000 |
| maximum draw ratio | 1.8 | 3.5 | 4.8 | 6.5 | 6.0 |

What is claimed is:

1. A non-porous yarn article comprising a tetrafluoroethylene polymer, which has a bulk density of 2.15 to 2.30, an orientation degree in an axial direction of 0.9 or more and a crystallinity of 85% or more and exhibits peaks at 345°±5° C. and 380°±5° C. in the thermogram of differential scanning calorimetry in the course of temperature elevation at a rate of 10° C./min.

2. The yarn article according to claim 1, having a tensile modulus of elasticity of 200 g/d or more.

3. The yarn article according to claim 1, which is a monofilament having a fineness of 100 denier or less.

* * * * *